US006012662A

United States Patent [19]

Sullivan

[11] Patent Number: 6,012,662

[45] Date of Patent: Jan. 11, 2000

[54] WASTE DISPOSAL APPARATUS CUTTER GUIDES

[75] Inventor: Donald J. Sullivan, Sandwich, Ill.

[73] Assignee: Environmental Systems & Solutions, Inc., Draper, Utah

[21] Appl. No.: 09/157,807

[22] Filed: Sep. 9, 1998

[51] Int. Cl.[7] ..... B02C 18/42

[52] U.S. Cl. ..... 241/46.013; 241/46.014; 241/299

[58] Field of Search ..... 241/46.013, 46.014, 241/46.01, 46.06, 291, 299

[56] References Cited

U.S. PATENT DOCUMENTS 3,700,178 10/1972 Verley .
4,082,229 4/1978 Boosman .
4,183,470 1/1980 Hovartos et al. ..... 241/46.11 X

*Primary Examiner*—John M. Husar
*Attorney, Agent, or Firm*—Thorpe, North & Western, LLP

[57] ABSTRACT

A waste disposal apparatus has cutter guides. The disposal apparatus has a plurality of cutters disposed in a passageway for comminuting waste. An annular ridge is formed in the wall of the passageway opposite an outer end or peripheral edge of the cutter In water powered waste disposal apparatus, a reciprocating piston is driven by pressurized water in an annular chamber. The piston is coupled to at least one rotatable cutter. The valve has a reciprocating control piston for selectively diverting the pressurized water into the annular chamber on alternate sides of the drive piston.

29 Claims, 5 Drawing Sheets

WASTE DISPOSAL APPARATUS CUTTER GUIDES

BACKGROUND OF THE INVENTION

1. The Field of the Invention

The present invention relates generally to a waste disposal device with cutter guides.

2. The Background Art

Waste disposal devices attached in-line with a sink drain have become commonplace. The waste disposal device cuts or shreds waste, such as food, table scraps, or other perishable items, so that the waste may pass through the plumbing of a house without clogging the pipes. The disposal units provide a convenience by allowing a person to simply wash waste into the sink without the burden of clearing the waste from the sink drain. The disposals also accommodate less time required to wash dishes by eluding the necessary step of wiping the waste into a trash receptacle.

Disposal units are typically mounted under the sink in the drain area just before the pipes leading to the remaining plumbing system. The disposals are connected in-line with a plumbing system so that water and waste will pass through the apparatus. Typically, cutters are rotatably mounted to disposals and coupled to an electric motor providing the cutters with a circular motion to cut waste as it passes through the apparatus.

Despite the conveniences provided by these waste disposal units, there are several disadvantages, one of which is the need for electrical wiring to operate the motor. Because of this, the devices are difficult to install and pose a danger of coupling an electric source to the water and plumbing system. Another disadvantage is the low starting torque of the electric motors. Waste initially disposed in the unit may stall the motor. Thus, the motor may burn out or pose a danger of injury as a user reaches into the unit to remove the clogged waste.

Attempts in the art to overcome the foregoing disadvantages of electric waste disposal units are provided in U.S. Pat. Nos. 3,700,178, issued Oct. 24, 1972, to Verley, and 4,082,229, issued Apr. 4, 1978, to Boosman, which disclose water powered waste disposal units The units have a housing defining an annular chamber around the unit. A reciprocating drive piston is slidingly disposed in the chamber and is coupled to a pivoting cutter in the housing. A valve alternately directs pressurized water into the annular chamber on opposite sides of the drive piston to drive the piston, and thus the cutter, in a reciprocal rotating motion.

Despite advantages presented by the above-described water powered waste disposal units, there are still disadvantages with the water powered and electric powered disposal units. One disadvantage is the high tolerances required to ensure proper alignment between the rotating cutters and the housing. In addition, the rotating cutters may become misaligned while cutting waste. If the cutters and housing are not aligned, the rotating cutters may bear against the housing, creating friction losses and may wear an indentation into the housing which may allow waste to bypass the cutters. In addition, misalignment may result in gaps between the cutters and housing which may allow waste to bypass the cutters. High tolerances make the units very expensive and are difficult to obtain in less expensive, injection molded parts. In addition, gaps allowing waste to bypass the cutters result in inefficient cutting. Furthermore, cutters bearing against the housing may strain the motor and result in further inefficiencies.

Therefore, it would be advantageous to develop a waste disposal apparatus capable of effectively and efficiently cutting waste. It would also be advantageous to develop a waste disposal apparatus capable of efficiently utilizing the motor. It would also be advantageous to develop a waste disposal apparatus capable of resisting the formation of gaps between the cutters and the housing. It would also be advantageous to develop a waste disposal apparatus capable of aligning the housing and the cutters. It would also be advantageous to develop a waste disposal apparatus capable of reducing friction losses. In addition, it would be advantageous to develop such a disposal apparatus capable of being manufactured inexpensively, or without excessive tolerances.

OBJECTS AND SUMMARY OF THE INVENTION

It is therefore an object of the present invention to provide a waste disposal apparatus for effectively and efficiently cutting waste.

It is another object of the present invention to provide such a waste disposal apparatus for efficiently utilizing the motor.

It is another object of the present invention to provide such a waste disposal apparatus which resists the formation of gaps between the cutters and the housing.

It is yet another object of the present invention to provide such a waste disposal apparatus for aligning the housing and the cutters, or maintaining cutter alignment.

It is a further object of the present invention to provide such a waste disposal apparatus which may be manufactured inexpensively, or without excessive tolerances.

The above objects and others not specifically recited are realized in a specific illustrative embodiment of a waste disposal apparatus with cutter guides for maintaining cutter alignment, preventing gaps where waste may bypass the cutters, and/or preventing friction losses. The disposal apparatus has a housing with a waste receiving inlet and a drain outlet. The housing also has an inner wall disposed between the inlet and outlet defining an intermediate comminuting chamber extending between the inlet and the outlet. The chamber has a longitudinal axis.

The disposal apparatus has at least one pivoting cutter rotatably disposed in the chamber. The at least one pivoting cutter may span across the chamber and be disposed about the longitudinal axis. The at least one pivoting cutter has an outer end or generally circular peripheral edge. The at least one pivoting cutter may comprise two pivoting cutters, including a primary pivoting cutter and a secondary pivoting cutter. The primary pivoting cutter is disposed closer to the inlet than the secondary pivoting cutter. The at least one cutter has a thickness measured parallel with the chamber. The disposal apparatus may also have at least one stationary cutter fixedly disposed in the chamber adjacent the at least one pivoting cutter.

The at least one pivoting cutter may have a hub and a plurality of arms extending radially from the hub. The cutter may have an annular member formed about the plurality of arms with a peripheral edge. The at least one cutter may have a generally circular plate with openings therein for allowing waste to pass through the openings and with a peripheral edge.

The disposal apparatus has means for rotating the at least one pivoting cutter. The disposal means may comprise an electric or hydraulic motor.

The disposal apparatus advantageously has at least one substantially annular ridge disposed on the inner wall of the housing. The annular ridge is generally opposing the outer end or peripheral edge of the at least one pivoting cutter.

In accordance with one aspect of the present invention the at least one ridge has a ridge height. The ridge height is measured from the inner wall of the housing towards the cutter. The ridge height is sized to create a gap between the at least one ridge and the outer end of the at least one cutter. The gap is large enough to allow the at least one cutter to rotate freely, but small enough to prevent a substantial amount of waste from bypassing the at least one cutter.

In accordance with another aspect of the present invention the at least one ridge comprises two ridges, including a first ridge and a second ridge. The first ridge is disposed on the inner wall opposite the primary pivoting cutter. The second ridge is disposed on the inner wall opposite the secondary pivoting cutter.

Each of the two ridges has a ridge height. The first ridge has a ridge height sized to create a first gap between the first ridge and the primary pivoting cutter. The second ridge has a ridge height sized to create a second gap between the second ridge and the secondary pivoting cutter. In accordance with another aspect of the present invention the first gap is larger than the second gap.

In accordance with another aspect of the present invention the at least one ridge is removably coupled to the inner wall.

In accordance with another aspect of the present invention the at least one ridge has a width measured parallel with the chamber. The at least one ridge has a width that is substantially the same as the thickness of the cutter.

In accordance with yet another aspect of the present invention the at least one ridge has a cross-sectional shape. The cross sectional shape may be triangular, rectangular, parabolic, or trapezoidal.

In accordance with another aspect of the present invention the waste disposal apparatus may be water powered. The rotating means may comprise an annular chamber disposed about the intermediate chamber A reciprocating drive piston is slidably disposed in the annular chamber and coupled to the at least one pivoting cutter. The rotating means also may have a valve for directing water into the annular chamber on alternating sides of the drive piston.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
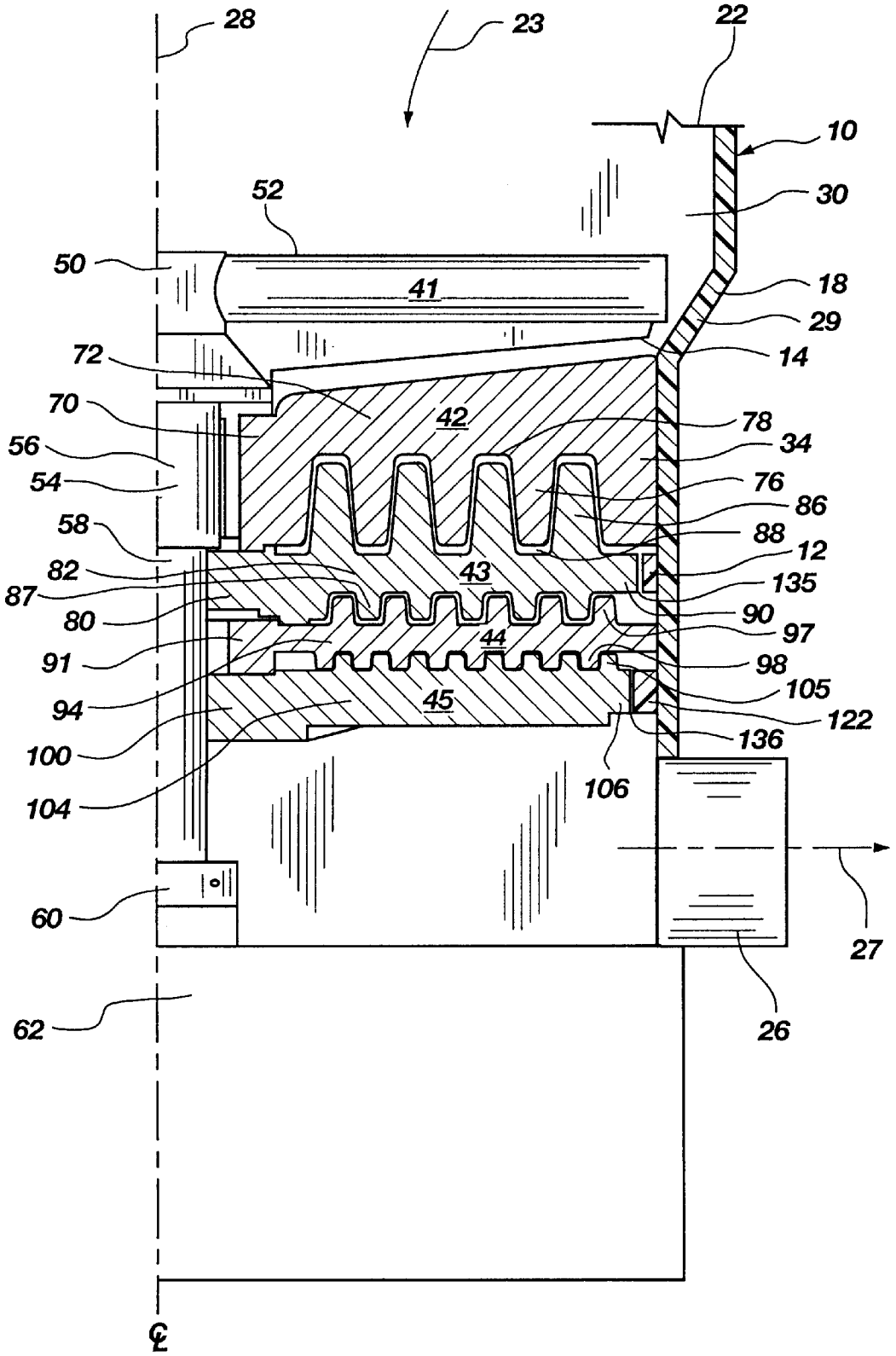
FIG. 1 is a partial cross-sectional side view of a waste disposal apparatus with an annular ridge in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Referring to FIG. 1, a waste disposal apparatus, indicated generally at 10, with an annular ridge 12 in accordance with the present invention is shown for maintaining cutter alignment, and preventing friction losses and/or excessive gaps. The waste disposal apparatus 10 has an apparatus housing 18 adapted for being disposed under a sink (not shown). The housing has a first end and a second end. The first end may be the top of the housing while the second end may be the bottom of the housing. The housing 18 has a waste receiving inlet 22 disposed at the first end for allowing the waste into the housing 18, indicated by arrow 23. The housing 18 and/or inlet 22 may be configured for being coupled to a drain (not shown) of a sink (not shown). The housing 18 also has a drain outlet 26 disposed at the second end for allowing the waste out of the housing 18, indicated by arrow 27. The outlet 26 may be configured for being coupled to a plumbing system (not shown).

Figure 6:
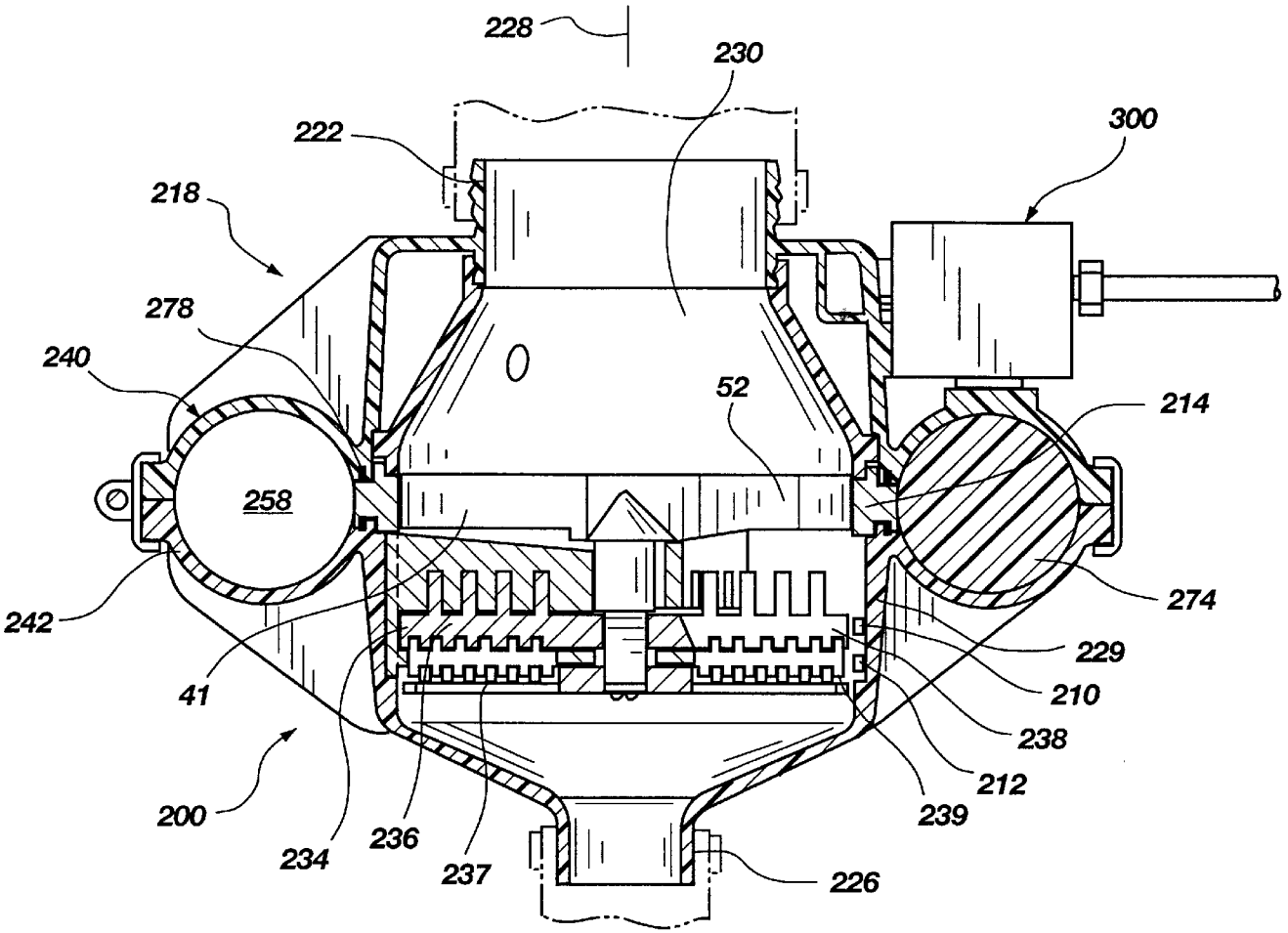
FIG. 6 is a cross sectional side view of a water powered waste disposal unit in accordance with the principles of the present invention.

The housing 18 also has an inner wall 29 disposed between the inlet 22 and outlet 26. The inner wall 29 may be a tube or tubular The inner wall 29 has an inner surface. The inner wall 29 defines a waste passage or intermediate comminuting chamber 30 extending between the waste inlet 22 and the outlet 26. The inner wall 29 preferably forms a circular passage or chamber 30 that extends linearly, but may have sections of various diameters. The passage or chamber 30 may have a longitudinal axis 28 extending between the first and second ends of the housing 18. The longitudinal axis may extend between the inlet 22 and outlet 26 as shown in FIG. 6. The housing 18 may also have a longitudinal axis which is concentric with the longitudinal axis 28 of the passage 30.

Figure 2:
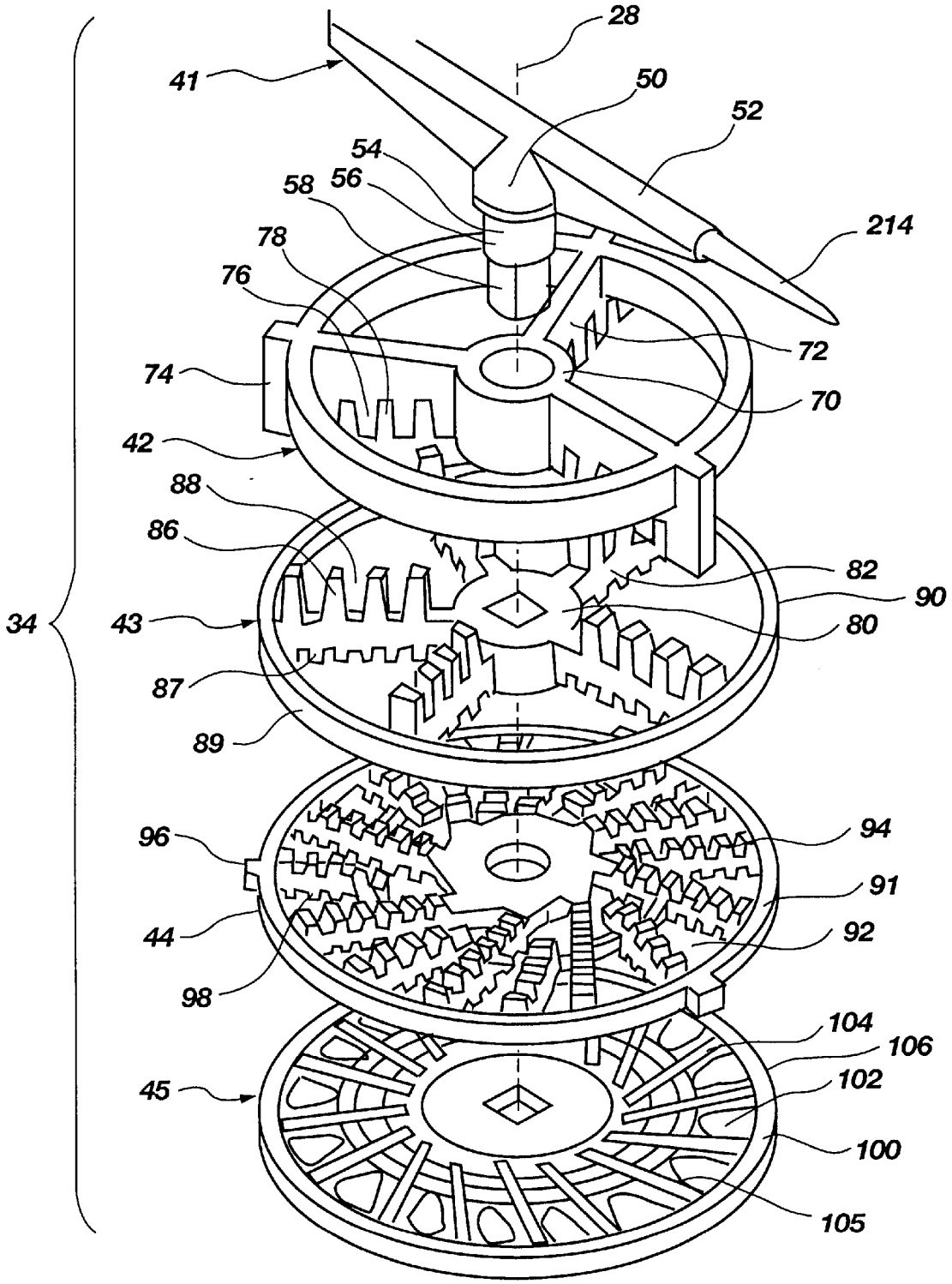
FIG. 2 is an exploded view of a cutter apparatus in accordance with the principles of the present invention.

A plurality of cutters 34 are disposed in the chamber 30 for cutting or shredding the waste as the waste passes through the chamber 30. The cutters 34 may be associated together in layers, or stacks. Referring to FIGS. 1 and 2, the cutters 34 may include a plurality of cutters with different configurations. As shown, the plurality of cutters 34 may include a first cutter 41, a second cutter 42 (or stationary cutter), a third cutter 43 (or primary or pivoting cutter), a fourth cutter 44 (or stationary cutter), and a fifth cutter 45 (or secondary or pivoting cutter). It is of course understood that any number of cutters could be employed and that the above five cutters are exemplary only.

The first cutter 41 has a first hub 50 disposed at the longitudinal axis 28 and a first arm 52 extending radially from the hub 50, or generally perpendicularly to the axis 28.

The first arm 52 spans across the chamber 30, as shown in FIG. 1. The first cutter 41 is pivotally disposed in the chamber 30, as shown in FIG. 1. The first arm 52 may be configured for engaging a driver as discussed more fully below. The first cutter 41 may have a shaft 54 extending from the first hub 50 along the longitudinal axis 28. The shaft 54 may have circular portions 56, or bearing portions, and square portions 58, or key portions. The shaft 54 has a first end fixedly coupled to the first hub 50 and a second end 60 fixedly coupled to a motor 62.

The motor 62 rotates the shaft 54, and thus the first cutter 41. The motor is one example of a drive means for rotating the cutters. Other drive means may be used, including for example an electric motor, a hydraulic motor, etc.

Figure 4:
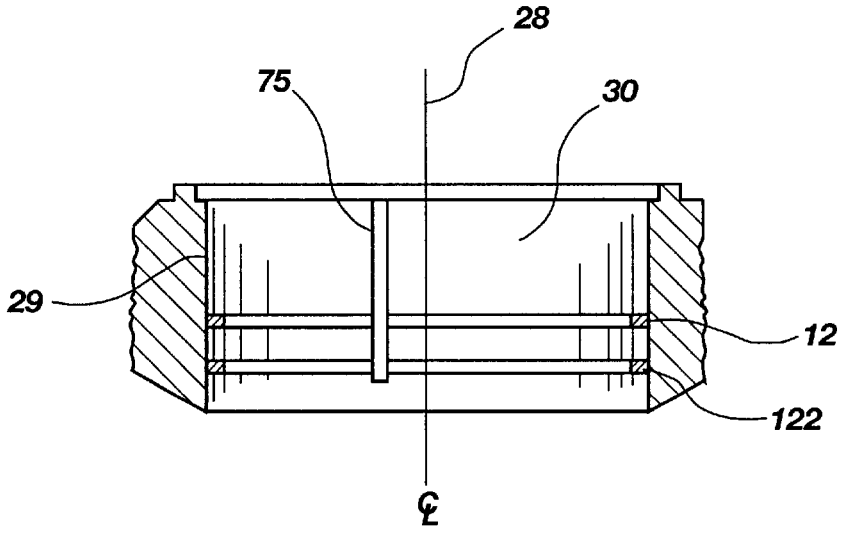
FIG. 4 is a cross section side view of a waste disposal apparatus with annular ridges in accordance with the principles of the present invention, taken along line 4–4 of FIG. 3.

The second cutter 42, also referred to herein as a stationary cutter, is disposed adjacent the first cutter 41. The second cutter 42 has a second hub 70, or stationary hub, disposed at the longitudinal axis 28. The second cutter 42 has a plurality of second arms 72 extending radially from the hub 70, or generally perpendicularly to the axis 28. The second arms 72, or the second cutter 42, span across the chamber 30, as shown in FIG. 1. The second cutter 42 is fixedly disposed in the passage 30, or is stationary, and has a tab 74, as shown in FIG. 2, for engaging a notch 75, as shown in FIG. 4, formed in the passage 30 to prevent the second cutter 42 from rotating.

The second hub 70 of the second cutter 42 has a second bore therein through which the shaft 54 passes. The second bore is circular and receives a circular portion 56 of the shaft 54 so that the shaft 54 may rotate freely with respect to the second hub 70. As the first cutter 41 rotates with respect to the second cutter 42, the first arm 52 passes adjacent the plurality of second arms 72, cutting waste therebetween.

A plurality of second teeth 76 are disposed or formed on the second arms 72. The second teeth 76 are spaced apart or staggered along the second arms 72. The second teeth 76 extend from the arms 72 towards the third cutter 43. The second teeth 76 define second spaces or grooves 78 therebetween.

The third cutter 43, also referred to herein as the primary cutter or a pivoting cutter, is disposed adjacent the second cutter 42 and has a primary hub 80 disposed at the longitudinal axis 28. The primary cutter 43 is disposed closer to the inlet 22 than the fifth cutter or secondary pivoting cutter 45. The primary cutter 43 has a plurality of primary arms 82 extending radially from the hub 80, or generally perpendicularly to the axis 28. The primary arms 82, or the primary cutter 43, span across the passage 30, as shown in FIG. 1. The primary cutter 43 is pivotally or rotatably disposed in the passage 30, as shown in FIG. 1.

The primary hub 80 of the primary cutter 43 has a primary bore therein through which the shaft 54 passes. The primary bore is square and receives a square portion 58 of the shaft 54 so that the primary hub 80 rotates with the shaft 54. Thus, the first cutter 41 and primary cutter 43 rotate with respect to the second cutter 42. It is of course understood that the shaft 54 and primary cutter 43 may be coupled or keyed in any suitable manner.

A plurality of primary teeth 86 are disposed or formed on the primary arms 82. The primary teeth 86 are spaced apart or staggered along the primary arms 82. The primary teeth 86 extend from the arms 82 towards the second cutter 42. The primary cutter 43 may also have a plurality of teeth 87 extending away from the second cutter 42. The primary teeth 86 define primary spaces or grooves 88 therebetween.

The second and primary teeth 76 and 86 intermesh as the primary cutter 43 rotates with respect to the second cutter 42. The second teeth 76 extend into the primary spaces 88. The primary teeth 86 extend into the second spaces 78. As the primary cutter 43 pivots, waste is cut between the second and primary teeth 76 and 86, and between the second and primary arms 72 and 82. The waste passes between the plurality of second arms 72 and between the plurality of primary arms 82 where it is cut as the primary teeth 86 pass by the second teeth 76.

The primary cutter 43 may have an annular support member 89 disposed at the ends of the primary arms 82 to support the secondary arms 82. The secondary arms 82 extend from the hub 80 to the support member 89. The primary cutter 43 has a peripheral edge 90 defined by the annular support member 89, or an outer end defined by the ends of the primary arms 82. The peripheral edge 90, or outer end of the arms, is the outermost portion of the cutter and extends across the chamber 30 nearly to the inner wall 29, or surface thereof, as shown in FIG. 1.

The fourth cutter 44 is disposed adjacent the primary cutter 43, or third cutter. The fourth cutter 44 may have a circular plate 91 with a plurality of openings 92 formed therein through which the waste may pass, as shown in FIG. 2. The openings 92 may be defined by arms 94 formed in the plate 90. The fourth cutter 44 is fixedly disposed in the passage 30, or is stationary, and has a tab 96, as shown in FIG. 2, for engaging a notch 75, as shown in FIG. 4, formed in the passage 30 to prevent the fourth cutter 44 from rotating. A plurality of teeth 97 are formed on the fourth cutter 44, or on the arms 94, extending towards the third cutter 43 and defining a plurality of grooves or spaces therebetween. The teeth 97 intermesh with the teeth 87 of the third cutter. The fourth cutter 44 may also have a plurality of teeth 88 extending towards the fifth cutter 45.

The plate 91 may have a bore therein through which the shaft 54 passes. The bore is circular and receives a circular portion 56 of the shaft 54 so that the shaft 54 may rotate freely with respect to the plate 91.

The fifth cutter 45, also referred to as the secondary cutter, is disposed adjacent the fourth cutter 44. Like the fourth cutter 44, the fifth cutter 45 may have a circular plate 100 with a plurality of openings 102 formed therein through which the waste may pass, as shown in FIG. 2. The openings 102 may be defined by arms 104 formed in the plate 100. A plurality of teeth are disposed on the fifth cutter 45, or on the arms 104, extending towards the fourth cutter 44 and defining a plurality of grooves or spaces therebetween. The teeth 105 intermesh with the teeth 97 of the fourth cutter 44. The fifth cutter 45 spans across the chamber 30, as shown in FIG. 1.

The fifth cutter 45 has a bore therein through which the shaft 54 passes. The bore is square and receives a square portion 58 of the shaft 54 so that the fifth cutter 45 rotates with the shaft 54. Thus, the first cutter 41, third cutter 43, and fifth cutter 45 rotate with respect to the second cutter 42 and the fourth cutter 44.

The fifth cutter 45 has a peripheral edge 106 which is the outermost portion of the cutter and extends across the chamber 30 nearly to the inner wall 29, or surface thereof, as shown in FIG. 1.

Figure 3:
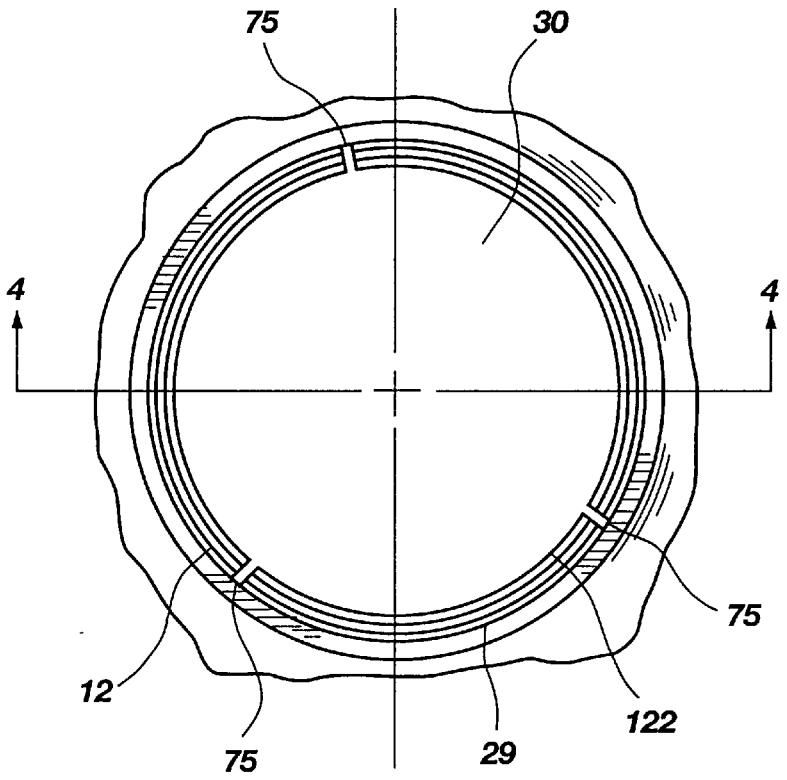
FIG. 3 is a partial top view of a waste disposal apparatus with annular ridges in accordance with the principles of the present invention.

Referring now to FIGS. 1, 3 and 4, the waste disposal apparatus 10 advantageously has a first annular ridge 12 and a second annular ridge 122, each disposed on the inner wall 29 of the housing 18. The first annular ridge 12 is disposed or located on the inner wall 29 generally opposing the peripheral edge 90 or the outer end of the third or primary cutter 43, as shown in FIG. 1. Similarly, the second annular ridge 122 is disposed or located on the inner wall 29 generally opposing the peripheral edge 106 or the outer end of the fifth or secondary cutter 45, also as shown in FIG. 1. The annular ridges 12 and 122 act as cutter guides for the pivoting cutters 43 and 45 and may come in contact with the pivoting cutters as they rotate.

The annular ridges 12 and 122 advantageously may help maintain the alignment of the cutters 43 and 45 as the cutters rotate. As the pivoting cutters 43 and 45 rotate about the shaft 54, or the longitudinal axis 28, and shred or cut waste, they may become misaligned. The intermeshing teeth may impact one another as the cutters misalign. In addition, the outer end or peripheral edge of the cutter may otherwise bear against the inner wall 29 or surface thereof. The misaligned cutters may jam as the intermeshing teeth impact. In addition, the cutters bearing against the inner wall may create friction losses and stall the motor. The annular ridges 12 and 122, however, advantageously help keep the cutters aligned, and thus prevent the cutters from jamming or bearing against the inner wall.

In addition, the passage or chamber 30 may not be perfectly circular. The actual chamber 30 may be slightly elliptical, or may otherwise deviate from circular, due to the manufacturing process. For example, if the housing 18 is formed by injection molding, it may be difficult to maintain strict tolerances and to obtain a perfectly circular chamber 30. Similarly, the pivoting cutters 43 and 45 may not be perfectly circular. The cutters are typically metal and may be machined or cast. The cutters may also be slightly elliptical, or may otherwise deviate from circular. Thus, the non-circular portions of the chamber 30 and cutters 43 and 45 may combine at certain points causing the cutters 43 and 45 to bear against or rub against the inner wall 29. Such contact between the cutters 43 and 45 and the wall 29 creates friction which may strain the motor or otherwise cause inefficient operation. In addition, the cutters 43 and 45 may wear a gap in the wall 29 where waste may bypass the cutters. The annular ridges 12 and 122 advantageously provide a smaller surface or wall against which the cutters 43 and 45 may bear and initially wear to form a proper fit. Thus, rather than under-sizing the cutters or over-sizing the chamber 30 to prevent contact, the annular ridges 120 and 122 may allow the cutters 43 and 45 and chamber 30 to be custom fit or self-fitting.

The annular ridges 12 and 122 may be broken into segments by the notch 75 which receives the tabs 74 and 96 of the stationary cutters 42 and 44. Thus, the annular ridges 12 and 122 may not be completely annular, or may be substantially annular.

Figure 5A:
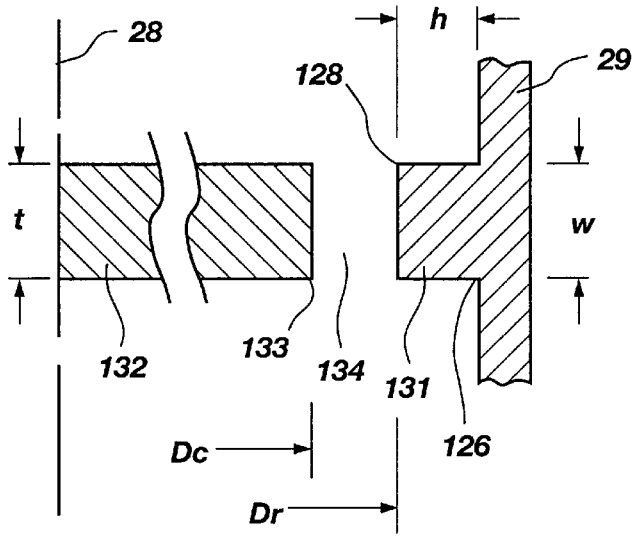
FIGS. 5*a–e* are cross sectional side views of annular ridges in accordance with the principles of the present invention.

Referring to FIG. 5*a*, the annular ridges, represented by annular ridge 131, have a base 126 and a tip 128. The base is disposed or formed on the inner wall 29 of the chamber 30 The annular ridges 131 also have a height, indicated at h, measured from the base 126, or inner wall 29, to the tip 128, or towards the primary and secondary pivoting cutters 43 and 45, represented by 132. In addition, the annular ridges 131 have an inner ridge diameter, indicated at $D_r$, measured across the chamber 30 between the tip 128 of the ridge 131 on one side and the tip at the other side. The annular ridges 131 also have a width, indicated by w, measured along or parallel to the chamber 30 or longitudinal axis 28 The cutters 132 may also have a diameter, indicated at $D_c$, defined by the peripheral edge 133, or outer ends. The cutters 132 have a thickness, indicated at t, measured along or parallel to the chamber 30 or longitudinal axis 28.

The cutter 132 and annular ridge 131 define a gap 134 therebetween. The annular ridges 131, and/or the cutters 132, may be sized to create a gap 134 that is large enough to allow the cutters 132 to rotate freely, but small enough to prevent a substantial amount of waste from bypassing the cutters. The primary cutter 43 and first annular ridge 120 define a first gap 135 therebetween while the secondary cutter 45 and second annular ridge 122 define a second gap 136 therebetween, as shown in FIG. 1. The first gap 135 formed between the first annular ridge 120 and primary cutter 43 may be larger than the second gap 136 formed between the second annular ridge 122 and the secondary cutter 45, as shown in FIG. 1. The first gap may not need to be as small to prevent waste from bypassing the cutters because the waste may still be relatively large at that point; whereas the second gap may need to be smaller to prevent waste from bypassing the cutter because the waste may be smaller at that point.

The width w of the annular ridges 131 may be substantially the same as the thickness t of the cutters 132. Thus, the cutters 132 may bear against the annular ridges 131 and form a custom fit. The width w of the annular ridges 131 may be less than the cutters 132 to prevent friction losses. The width w may also vary, as discussed below.

Figure 5B:
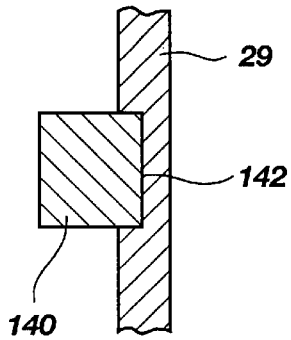

Referring to FIG. 5*b*, the annular ridges, represented by annular ridge 140, may be removably disposed on the inner wall 29, or removably coupled to the inner wall 29. Providing removable ridges 140 allows the ridges to be removed and replaced as they become worn. The annular ridge 140 may be an annular member or ring. An annular groove or channel 142 may be formed in the inner wall 29 into which the annular ridge or ring 140 is inserted. Because of the notches 75 formed in the inner wall 29 to prevent the stationary cutters 42 and 44 from pivoting, the annular groove 142 may be formed in segments and the annular ridge or ring 140 may also be formed in segments. The ridge 140 may be made from a low friction material and may act as a bearing surface for the cutter.

Figure 5C:
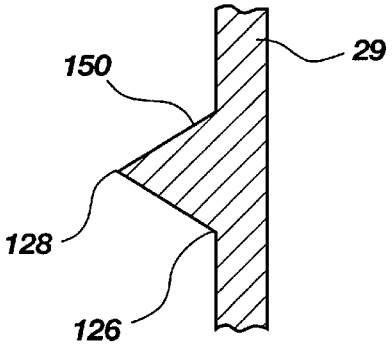
Figure 5E:
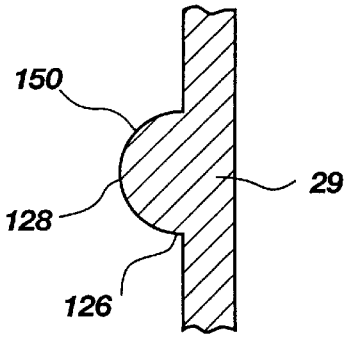
Figure 5D:
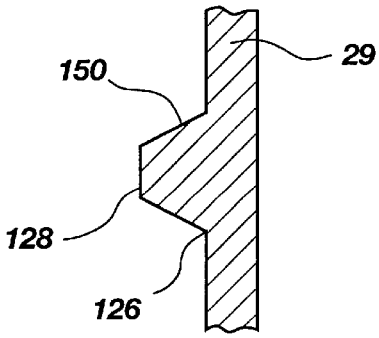

Referring to FIGS. 5*c*–5*e* the annular ridges 120 and 122, represented by annular ridge 150, may have various cross-sectional shapes. The cross section of the annular ridges 150 is taken radially from the longitudinal axis 28, or by a plane extending radially from the longitudinal axis 28. Referring now to FIG. 5*c*, the annular ridges 150 may have a triangular cross section. The width w of the annular ridge 150 varies, becoming narrower as the ridge extends from the base 126 or wall 29 to the tip 128. The reduced width w of the ridge 150 at the tip 128 presents less material for the cutter to wear away. Thus, in initial use, the cutter may quickly wear away portions of the tip 128 of the ridges 150 to form a custom fit between the cutters and the ridges. In addition, the ridge 150 has a pointed tip 128. The pointed tip 128 presents less surface area against which the cutters may bear, which may thus reduce friction and prevent wear on the motor. Referring now to FIG. 5*d*, the annular ridges 150 may have a trapezoidal cross section. Again, the width w of the ridge 150 reduces from the base 126 to the tip 128. Referring now to FIG. 5*e*, the annular ridges 150 may have a circular cross section. The circular cross section also has a narrower width w at the tip 128. Referring to FIG. 5*a*, the annular ridges 131 may have a square or rectangular cross section. The annular ridges 150 may also have a parabolic, rectangular, or elliptical cross-section.

Although the foregoing discussion has been directed toward a single annular ridge and a single cutter, it is understood that the foregoing discussion applies to both the first and second annular ridges 12 and 122 and both the primary and secondary cutters 43 and 45.

It is of course understood that a plurality of ridges may be associated with a single cutter. For example, two ridges may be formed on the wall generally opposing the cutter. In addition, it is understood that the first annular ridge 12 may have one cross section, such as triangular, and the second annular ridge 122 may have another, different cross section, such as square.

Referring to FIG. 6, a specific illustrative embodiment of a water powered waste disposal apparatus, indicated generally at 200, is shown with cutter guides, or first and second annular ridges 210 and 212. The annular ridges 210 and 212 are substantially similar to the annular ridges 12 and 122 described above.

The apparatus 200 has an apparatus housing 218 adapted for being disposed under a sink (not shown). The housing 218 has a waste receiving inlet 222 disposed generally at the top of the housing 218 for allowing the waste into the housing 218. The housing 218 and/or inlet 222 may be configured for being coupled to a drain (not shown) of a sink (not shown). The housing 218 also has a drain outlet 226 disposed generally at the bottom of the housing 218 for allowing the waste out of the housing 218. The housing 218 may have a longitudinal axis 228 extending vertically between the inlet 222 and outlet 226.

The housing 218 also has an inner wall 229 disposed between the inlet 222 and outlet 226. The inner wall 229 may be a tube or tubular. The inner wall 229 has an inner surface. The inner wall 229 defines a waste passage or intermediate comminuting chamber 230 extending between the waste inlet 222 and the outlet 226. The inner wall 229 preferably forms a circular passage or chamber 230 that extends linearly, but may have sections of various diameters. The longitudinal axis may extend between the inlet 222 and outlet 226. The housing 218 may also have a longitudinal axis which is concentric with the longitudinal axis 228 of the passage 230.

A plurality of cutters 234 are disposed in the passage 230. The cutters 234 are similar in most respects to the cutters 34 shown in FIGS. 1 and 2. The first cutter 41 has a protrusion 214 formed on the first arm 52 as will be discussed in further detail below.

The cutters 234 include a primary pivoting cutter 236 and a secondary pivoting cutter 238, each with an outer end or peripheral edge 238 and 239, respectively The first and second annular ridges 210 and 212 are formed in the wall 229 of the chamber 230 generally opposing the primary and secondary cutters 236 and 237, respectively.

The water powered apparatus 200 also has a driver 240. A drive housing 242 is coupled to the apparatus housing 218 and defines an annular chamber 258 formed about the passage 230 or the longitudinal axis 228. The annular chamber 258 has a torus or donut shape and preferably has a circular cross section.

A reciprocating drive piston 274 is slidably disposed in the annular chamber 258. The drive piston 274 may move or slide within the annular chamber 258 in a rotational motion. The drive piston 274 has the same cross section as the annular chamber 58, such as circular. The drive piston 274 has a perimeter or edge which slidably seals against the inner wall of the annular chamber 258.

The drive piston 274 is coupled to the first cutter 41, and thus the primary and secondary pivoting cutters 236 and 237. Thus, as the drive piston 274 rotates in the annular chamber 258, it drives or forces the first cutter 41 to pivot in the passage 230 of the housing 218. An annular opening 278 is formed in an inner wall of the annular chamber 258 and a wall of the passage 230 so that the opening 278 extends between the passage 230 and annular chamber 258. A dynamic annular seal is disposed in the annular opening 278. The drive piston 274 and the first cutter 41 couple through the annular opening 278. The protrusion 214 formed on the arm 52 of the first cutter 41 extends through the annular opening 278 and couples to the drive piston 274. It is of course understood that the drive piston may be coupled to either the primary or secondary cutters.

A control valve 300 is coupled to the drive housing 242. The control valve 300 supplies pressurized water from a source of pressurized water alternately to opposite sides of the drive piston 274, to drive the drive piston 274 in a reciprocal manner.

It is to be understood that the above-described arrangements are only illustrative of the application of the principles of the present invention Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A waste disposal apparatus comprising:

a housing having an inlet, an outlet, and an inner wall disposed between the inlet and outlet defining an intermediate chamber extending between the inlet and the outlet;

at least one pivoting cutter rotatably disposed in the chamber and having an outer end;

means for rotating the at least one pivoting cutter; and at least one substantially annular ridge disposed on the inner wall of the housing generally opposing the outer end of the at least one pivoting cutter forming a cutter guide such that the cutter guide helps maintain alignment of the at least one pivoting cutter and hells prevent the at least one pivoting cutter from bearing against the inner wall of the housing.

2. The waste disposal apparatus of claim 1, wherein the at least one ridge has a ridge height measured from the inner wall of the housing towards the cutter, the ridge height being sized to create a gap between the at least one ridge and the outer end of the at least one cutter that is large enough to allow the at least one cutter to rotate freely, but small enough to prevent a substantial amount of waste from bypassing the at least one cutter.

3. The waste disposal apparatus of claim 1, wherein the at least one cutter comprises two pivoting cutters including a primary cutter and a secondary cutter, the primary cutter being disposed closer to the inlet than the secondary cutter, and wherein the at least one ridge comprises two ridges including a first ridge and a second ridge, the first ridge being disposed on the inner wall opposite the primary cutter and the second ridge being disposed on the inner wall opposite the secondary cutter.

4. The waste disposal apparatus of claim 3, wherein each of the two ridges has a ridge height measured from the inner wall of the housing towards the primary and secondary cutters, the first ridge having a ridge height sized to create a first gap between the first ridge and the primary cutter, the second ridge having a ridge height sized to create a second gap between the second ridge and the secondary cutter, the first gap being larger than the second gap.

5. The waste disposal apparatus of claim 1, wherein the at least one ridge is removably coupled to the inner wall.

6. The waste disposal apparatus of claim 1, wherein the at least one cutter has a thickness measured parallel with the chamber, and wherein the at least one ridge has a width measured parallel with the chamber that is substantially the same as the thickness of the cutter.

7. The waste disposal apparatus of claim 1, wherein the chamber has a longitudinal axis, and wherein the at least one ridge has a cross-sectional shape taken radially from the longitudinal axis selected from the group consisting of: triangular, rectangular, parabolic, or trapezoidal.

8. The waste disposal apparatus of claim 1, wherein the means for rotating is a hydraulic motor.

9. The waste disposal apparatus of claim 1, wherein the means for rotating is an electric motor.

10. The waste disposal apparatus of claim 1, wherein the rotating means comprises an annular chamber disposed about the intermediate chamber, a reciprocating drive piston slidably disposed in the annular chamber and coupled to the at least one cutter, and a valve for directing water into the annular chamber on alternating sides of the drive piston.

11. The waste disposal apparatus of claim 1, wherein the at least one ridge has a cross-sectional shape taken radially from the longitudinal axis selected from the group consisting of: triangular, rectangular, parabolic, or trapezoidal.

12. The waste disposal apparatus of claim 1, wherein at least a portion of the annular ridge is initially sized to bear against at least a portion of the outer end of the at least one cutter.

13. The waste disposal apparatus of claim 1, wherein the annular ridge is formed of a material which is softer than a material forming the at least one cutter such that the at least one cutter wears the material of the annular ridge where the at least one cutter contacts the annular ridge.

14. The waste disposal apparatus of claim 1, wherein the annular ridge has a tip and a base, and wherein the tip is narrower than the base, thereby presenting less material for the cutter to wear away.

15. A waste disposal apparatus comprising:

a housing having a waste receiving inlet, a drain outlet, and an inner wall disposed between the inlet and outlet defining an intermediate comminuting chamber, the chamber having a longitudinal axis;

at least one pivoting cutter spanning across the chamber and rotatably disposed in the chamber about the longitudinal axis, the at least one pivoting cutter having a generally circular peripheral edge;

rotating means for rotating the at least one pivoting cutter;

at least one substantially annular ridge disposed on the inner wall generally opposing the peripheral edge of the at least one pivoting cutter, the annular ridge comprising at least one elongated Protrusion extending from the inner wall of the housing and having a tip with a continuous, flat surface generally opposing the peripheral edge of the at least one pivoting cutter.

16. The waste disposal apparatus of claim 15, wherein the at least one ridge has a ridge height measured from the inner wall of the housing towards the cutter, the ridge height being sized to create a gap between the at least one ridge and the peripheral edge of the at least one cutter that is large enough to allow the at least one cutter to rotate freely, but small enough to prevent a substantial amount of waste from bypassing the at least one cutter.

17. The waste disposal apparatus of claim 16, wherein the rotating means comprises an annular chamber disposed about the intermediate comminuting chamber, a reciprocating drive piston slidably disposed in the annular chamber and coupled to the at least one cutter, and a valve for directing water into the annular chamber on alternating sides of the drive piston.

18. The waste disposal apparatus of claim 15, wherein the at least one cutter comprises two cutters including a primary cutter and a secondary cutter, the primary cutter being disposed closer to the inlet than the second cutter, and wherein the at least one ridge comprises two ridges including a first ridge and a second ridge, the first ridge being disposed on the inner wall opposite the primary cutter and the second ridge being disposed on the inner wall opposite the secondary cutter.

19. The waste disposal apparatus of claim 18, wherein each of the two ridges has a ridge height measured from the inner wall of the housing towards the primary and secondary cutters, the first ridge having a ridge height sized to create a first gap between the primary ridge and the first cutter, the second ridge having a ridge height sized to create a second gap between the second ridge and the secondary cutter, the first gap being larger than the second gap.

20. The waste disposal apparatus of claim 15, wherein the at least one ridge is removably coupled to the inner wall.

21. The waste disposal apparatus of claim 15, wherein the at least one cutter has a thickness measured parallel with the chamber, and wherein the at least one ridge has a width measured parallel with the chamber that is substantially the same as the thickness of the cutter.

22. The waste disposal apparatus of claim 1, wherein the at least one ridge has a cross-sectional shape taken radially from the longitudinal axis selected from the group consisting of: triangular, rectangular, parabolic, or trapezoidal.

23. A water powered waste disposal apparatus comprising:

a housing having a waste receiving inlet, a drain outlet, and an inner wall disposed between the inlet and the outlet defining an intermediate comminuting chamber, the chamber having a longitudinal axis;

at least one pivoting cutter spanning across the chamber and rotatably disposed in the chamber, the at least one pivoting cutter having a generally circular peripheral edge;

hydraulic rotating means for rotating the at least one cutter comprising an annular chamber disposed about the intermediate comminuting chamber, and a reciprocating drive piston slidably disposed in the annular chamber and coupled to the at least one pivoting cutter;

a valve for directing water into the annular chamber on altering sides of the drive piston; and at least one substantially annular ridge disposed on the inner wall generally opposing the peripheral edge of the at least one pivoting cutter, the annular ridge comprising at least one elongated protrusion extending from the inner wall of the housing and having a continuous tip generally opposing the peripheral edge of the at least one pivoting cutter.

24. The waste disposal apparatus of claim 23, wherein the at least one ridge has a ridge height measured from the inner wall of the housing towards the cutter, the ridge height being sized to create a gap between the at least one ridge and the outer end of the at least one cutter that is large enough to allow the at least one cutter to rotate freely, but small enough to prevent a substantial amount of waste from bypassing the at least one cutter.

25. The waste disposal apparatus of claim 23, wherein the at least one cutter comprises two cutters including a primary cutter and a secondary cutter, the primary cutter being disposed closer to the inlet than the second cutter, and wherein the at least one ridge comprises two ridges including a first ridge and a second ridge, the first ridge being disposed on the inner wall opposite the primary cutter and the second ridge being disposed on the inner wall opposite the secondary cutter.

26. The waste disposal apparatus of claim 25, wherein each of the two ridges has a ridge height measured from the inner wall of the housing towards the primary and secondary cutters, the first ridge having a ridge height sized to create a first gap between the first ridge and the primary cutter, the second ridge having a ridge height sized to create a second gap between the second ridge and the secondary cutters the first gap being larger than the second gap.

27. The waste disposal apparatus of claim 23, wherein the at least one ridge is removably coupled to the inner wall.

28. The waste disposal apparatus of claim 23, wherein the at least one cutter has a thickness measured parallel with the chamber, and wherein the at least one ridge has a width measured parallel with the chamber that is substantially the same as the thickness of the cutter.

29. The waste disposal apparatus of claim 23, further comprising at least one stationary cutter fixedly disposed in the chamber adjacent the at least one cutter.

* * * * *